US008552879B2

(12) United States Patent
Hoover et al.

(10) Patent No.: US 8,552,879 B2
(45) Date of Patent: Oct. 8, 2013

(54) METHOD AND APPARATUS FOR DETERMINING THE AMOUNT OF MEDIA ON AN ELEVATOR THAT SUPPORTS A MEDIA STACK IN AN IMAGE PRODUCTION DEVICE

(75) Inventors: Martin E. Hoover, Rochester, NY (US); Douglas K. Herrmann, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 414 days.

(21) Appl. No.: 12/909,486

(22) Filed: Oct. 21, 2010

(65) Prior Publication Data

US 2012/0098660 A1 Apr. 26, 2012

(51) Int. Cl.
*G08B 21/00* (2006.01)
*B41J 17/22* (2006.01)

(52) U.S. Cl.
USPC ..... 340/673; 340/675; 340/517; 340/524; 347/215; 347/218

(58) Field of Classification Search
USPC ..... 340/500, 517, 524, 525, 673, 674, 675, 340/815.4, 815.47; 271/126, 148, 152, 153, 271/154, 155; 347/171, 215, 218; 358/1.16, 358/1.18, 3.28
See application file for complete search history.

(56) References Cited

U.S. PATENT DOCUMENTS 5,839,015 A 11/1998 Faguy et al.
6,825,864 B2 * 11/2004 Botten et al. ..... 347/215
6,986,511 B2 * 1/2006 Yamada et al. ..... 271/294
7,116,343 B2 * 10/2006 Botten et al. ..... 347/218
7,187,476 B2 * 3/2007 Umeda et al. ..... 358/3.28
7,375,737 B2 * 5/2008 Botten et al. ..... 347/171
7,773,266 B2 * 8/2010 Umeda et al. ..... 358/3.28
7,887,045 B2 * 2/2011 Baena et al. ..... 271/152
7,913,995 B2 * 3/2011 Clark et al. ..... 271/126
8,302,964 B2 * 11/2012 Obuchi et al. ..... 271/302

FOREIGN PATENT DOCUMENTS

EP 0919500 A3 6/1999
EP 1348661 A1 10/2003
EP 1798170 A1 12/2005

OTHER PUBLICATIONS

GB Search Report Issued in Related GB Application No. 1117657.5, dated Feb. 13, 2012.
Douglas K. Herrmann & Martin E. Hoover; "Horizontal Sensor and Variable Pattern for Detecting Vertical Stacker Position"; U.S. Appl. No. 12/766,323, filed Apr. 23, 2010.

* cited by examiner

*Primary Examiner* — Van T. Trieu
(74) *Attorney, Agent, or Firm* — Ronald E. Prass, Jr.; Prass LLP

(57) ABSTRACT

A method and apparatus for determining the amount of media on an elevator that supports a media stack in an image production device is disclosed. The method may include sensing one or more identification mark on a segmented positional reference scale, determining the elevator's position based on the sensed one or more identification mark, and determining an amount of media on the elevator based on the determined elevator position.

18 Claims, 5 Drawing Sheets

METHOD AND APPARATUS FOR DETERMINING THE AMOUNT OF MEDIA ON AN ELEVATOR THAT SUPPORTS A MEDIA STACK IN AN IMAGE PRODUCTION DEVICE

BACKGROUND

Disclosed herein is a method for determining the amount of media on an elevator that supports a media stack in an image production device, as well as corresponding apparatus and computer-readable medium.

In conventional finishing devices and feeders in image production devices, paper elevator position control generally involves stack height switches, corner sensors, and comb brackets with multiple transmissive sensors/algorithms to determine elevator position and direction. These methods require an elevator to initialize (or home) at some position which is usually at the top or bottom of travel. They measure position in the middle of travel by counting from the home position using stepper motor steps or sensor steps using a linear encoder. As an example, some image production devices use a comb bracket and three sensors to identify motion and upper and lower position only. The sensors are located on the elevator that detect transitions on a "comb bracket" located at the back of the frame. Often this process requires the elevator to travel to the bottom (or top) of its range to home, and then to move to the desired intermediate position during printer cycle up. This method takes a long time and several sensors are needed to identify elevator location (limited capability) and elevator motion.

SUMMARY

A method and apparatus for determining the amount of media on an elevator that supports a media stack in an image production device is disclosed. The method may include sensing one or more identification mark on a segmented positional reference scale, determining the elevator's position based on the sensed one or more identification mark, and determining an amount of media on the elevator based on the determined elevator position.

DETAILED DESCRIPTION

Figure 1:
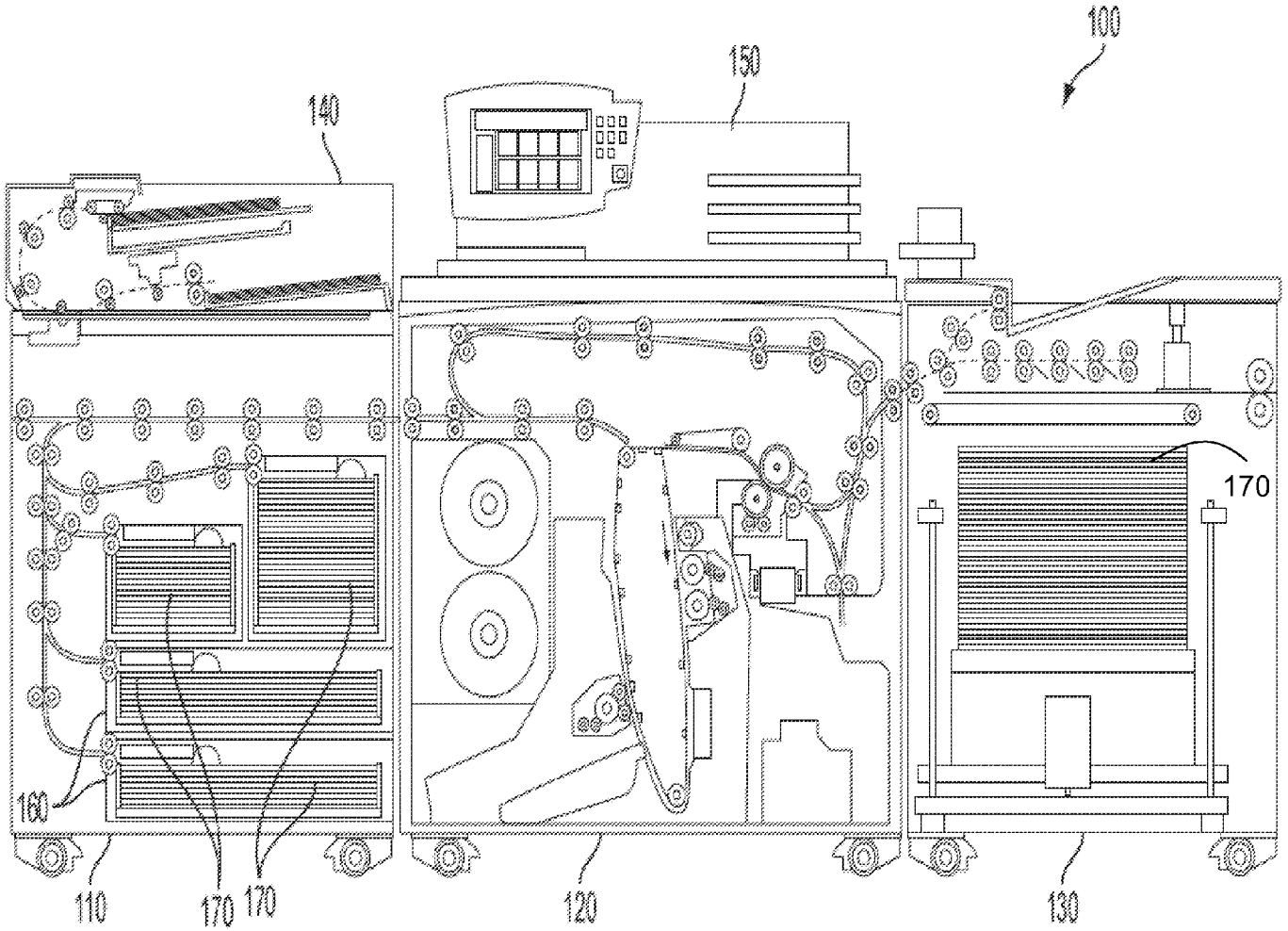
FIG. 1 is an exemplary diagram of an image production device in accordance with one possible embodiment of the disclosure.

Aspects of the embodiments disclosed herein relate to a method for determining the amount of media on an elevator that supports a media stack in an image production device, as well as corresponding apparatus and computer-readable medium.

The disclosed embodiments may include a method for determining the amount of media on an elevator that supports a media stack in an image production device. The method may include sensing one or more identification mark on a segmented positional reference scale, determining the elevator's position based on the sensed one or more identification mark, and determining an amount of media on the elevator based on the determined elevator position.

The disclosed embodiments may further include an image production device that may include a segmented positional reference scale, an elevator position sensor that senses one or more identification mark on the segmented positional reference scale, and an elevator position determination unit that determines an elevator position based on the sensed one or more identification mark, and determines an amount of media on the elevator based on the determined elevator position.

The disclosed embodiments may further include a computer-readable medium storing instructions for controlling a computing device determining the amount of media on an elevator that supports a media stack in an image production device. The instructions may include sensing one or more identification mark on a segmented positional reference scale, determining the elevator's position based on the sensed one or more identification mark, and determining an amount of media on the elevator based on the determined elevator position.

Conventional elevator controls consistently rely on encoder type controls (linear or rotary) that limit the ability of a stacker/feeder system to accurately determine its location (without a homing operation) and to determine both motion and location in real time with accuracy. The encoder style designs rely on the intermittent triggering of point sensors that look for transitions in either linear or rotary segmented targets.

Because these systems look only at transitions:

Location is identified by an encoder count. To ensure the encoder counts are accurate homing is required.

In addition because the motion is detected by transitions, there is a need to confirm motion and not noise is triggering the transition.

Elevator must perform homing operation any time the system has a shutdown or to confirm elevator has not been moved.

Additional sensors are needed to ensure that the elevator does not move past the upper or lower limits.

To overcome the shortcomings of the prior art, the disclosed embodiments may concern an array sensor (e.g., a low-cost contact image sensor (CIS), etc.) that may be used to identify both elevator motion and location accurately without the need for homing. The absolute location of the elevator may be determined directly from the sensor readout. However, there is a cost issue with using a single or stitched sensor system able to span the entire elevator travel distance. This distance can be considerable (e.g., 18" or more).

The idea described in the disclosed embodiments may be a method for reducing the elevator motion to be detectable by a small CIS sensor such as an A6 (100 mm) or A8 (54 mm). This embodiment may significantly reduce the cost and complexity associated with using a longer CIS system.

One possible embodiment in which the CIS is mounted on the elevator vertically so that it detects a segmented positional reference scale on the frame (e.g., a decal, etchings, indentations, etc., attached to a frame in either the feeder section 110 or output section 130 of the image production device 100), the sensor's inherent ability to measure linear position over a limited range may be used to identify location relative to a reference mark. The sensor may also able to detect additional identification marks allowing it to cover a larger span as a series of segmented zones. Using the sensor in this way may allow the inherent high resolution to be used over the full range of travel by being able to detect which zone or segment it is looking at then measuring actual position relative to the index mark for each particular zone.

This concept may be applicable to many applications involving elevator type motion now being controlled with encoders. In the conventional finishing module elevator control development, a combination of several sensors, a unique custom sensor design and a set of complex algorithms were used in an attempt to provide the necessary controls. Currently, this design is still not capable of detecting elevator location or accurate motion and the customer is still required to wait for a homing operation to be completed. However, the disclosed embodiments may solve these issues, reduce complexity, and improve performance by providing these functions in real time.

In one possible embodiment, an inherent high resolution of the 2" image sensor may be retained by adding index marks and associated ID marks that can be detected by processing the linear image sensor signal. Index marks may be spaced far enough apart so the image sensor always has one to use to measure relative to. As the object moves out of one zone and into another, the sensor signal processing may account for which index mark it is measuring with respect to another.

The disclosed embodiments may include the use of multiple segments with a track of reference marks to enable higher resolution linear position sensing over long spans. In this manner, the disclosed embodiments may not use optical or mechanical reduction that reduce resolution to enable sensing over longer range of travel with short length linear image sensor. The disclosed embodiments may also use of simple pattern of periodic spaced reference scale marks with nearby segment identification marks and signal processing to enable detection of absolute location.

The benefits of the disclosed embodiments over conventional systems may include:

Better sensor availability due to reduced length, complexity and cost.

Reduction in part count by eliminating multiple sensors for upper, lower limits, encoder sensor and associated comb.

Real time feedback for both location and motion.

Reduced need for debounce algorithms to differentiate between real motion and noise.

Improved safety due to fast/small motion detection.

Elimination of homing operation during run and after unload or shutdown.

Expanded ability for use to determine stack size improved ability to adjust for different stacking configurations (i.e., offset stacking, staple stacking, weight basis stacking or curl effects).

FIG. 1 is an exemplary diagram of an image production device 100 in accordance with one possible embodiment of the disclosure. The image production device 100 may be any device or combination of devices that may be capable of making image production documents (e.g., printed documents, copies, etc.) including a copier, a printer, a facsimile device, and a multi-function device (MFD), for example.

The image production device 100 may include an image production section 120, which includes hardware by which image signals are used to create a desired image, as well as a stand-alone feeder section 110, which stores and dispenses sheets on which images are to be printed, and an output section 130, which may include hardware for stacking, folding, stapling, binding, etc., prints which are output from the marking engine. If the image production device 100 is also operable as a copier, the image production device 100 may further include a document feeder 140, which operates to convert signals from light reflected from original hard-copy image into digital signals, which are in turn processed to create copies with the image production section 120. The image production device 100 may also include a local user interface 150 for controlling its operations, although another source of image data and instructions may include any number of computers to which the printer is connected via a network.

With reference to feeder section 110, the section may include any number of trays 160, each of which stores a media stack 170 or print sheets ("media") of a predetermined type (size, weight, color, coating, transparency, etc.) and may include a feeder to dispense one of the sheets therein as instructed. Certain types of media may require special handling in order to be dispensed properly. For example, heavier or larger media may desirably be drawn from a media stack 170 by use of an air knife, fluffer, vacuum grip or other application (not shown in the Figure) of air pressure toward the top sheet or sheets in a media stack 170. Certain types of coated media may be advantageously drawn from a media stack 170 by the use of an application of heat, such as by a stream of hot air (not shown in the Figure). Sheets of media drawn from a media stack 170 on a selected tray 160 may then be moved to the image production section 120 to receive one or more images thereon. Then, the printed sheet is then moved to output section 130, where it may be collated, stapled, folded, punched, etc., with other media sheets in manners familiar in the art.

Note that the image production device 100 may be or may include a stand-alone feeder section 110 (or module) and/or a stand-alone output (finishing) section 130 (or module within the spirit and scope of the disclosed embodiments.

Figure 2:
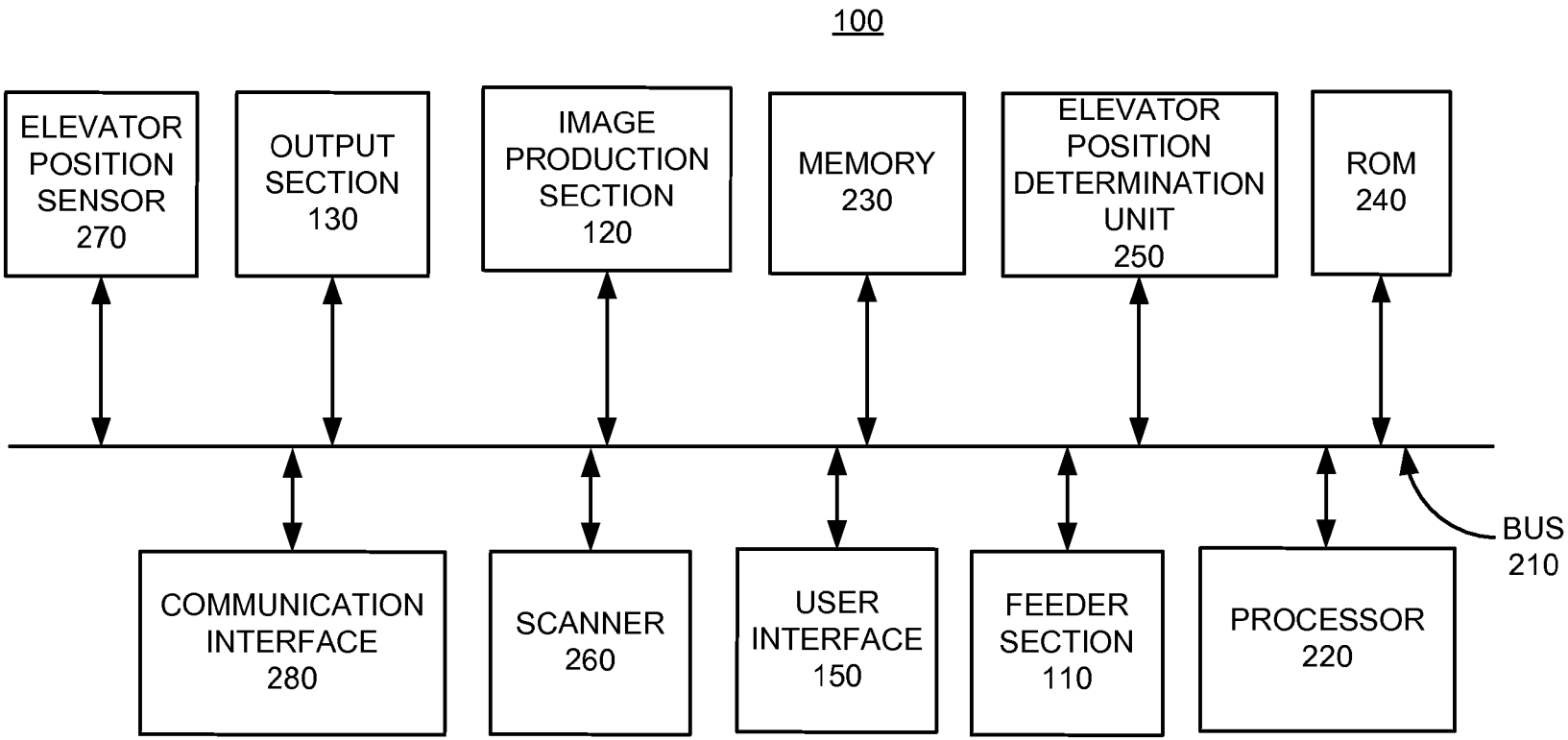
FIG. 2 is an exemplary block diagram of the image production device in accordance with one possible embodiment of the disclosure.

FIG. 2 is an exemplary block diagram of the image production device 100 in accordance with one possible embodiment of the disclosure. The image production device 100 may include a bus 210, a processor 220, a memory 230, a read only memory (ROM) 240, a elevator position determination unit 250, a feeder section 110, an output section 130, a user interface 150, a scanner 260, an elevator position sensor 270, a communication interface 280, and an image production section 120. Bus 210 may permit communication among the components of the image production device 100.

Processor 220 may include at least one conventional processor or microprocessor that interprets and executes instructions. Memory 230 may be a random access memory (RAM) or another type of dynamic storage device that stores information and instructions for execution by processor 220. Memory 230 may also include a read-only memory (ROM) which may include a conventional ROM device or another type of static storage device that stores static information and instructions for processor 220.

Communication interface 280 may include any mechanism that facilitates communication via a network. For example, communication interface 280 may include a modem. Alternatively, communication interface 280 may include other mechanisms for assisting in communications with other devices and/or systems.

ROM 240 may include a conventional ROM device or another type of static storage device that stores static information and instructions for processor 220. A storage device may augment the ROM and may include any type of storage media, such as, for example, magnetic or optical recording media and its corresponding drive.

User interface 150 may include one or more conventional mechanisms that permit a user to input information to and interact with the image production unit 100, such as a keyboard, a display, a mouse, a pen, a voice recognition device, touchpad, buttons, etc., for example. Output section 130 may include one or more conventional mechanisms that output image production documents to the user, including output trays, output paths, finishing section, etc., for example. The image production section 120 may include an image printing and/or copying section, a scanner, a fuser, etc., for example. The scanner 260 may be any device that may scan documents and may create electronic images from the scanned document. The scanner 260 may also scan, recognize, and decode marking-readable codes or markings, for example. The elevator position sensor 270 may be a contact image sensor (CIS), or a two-dimensional (2D) sensor array, for example.

The image production device 100 may perform such functions in response to processor 220 by executing sequences of instructions contained in a computer-readable medium, such as, for example, memory 230. Such instructions may be read into memory 230 from another computer-readable medium, such as a storage device or from a separate device via communication interface 280.

The operation of the elevator position determination unit 250 will be discussed in relation to the diagram in FIGS. 3 and 4 and the flowchart in FIG. 5.

Figure 3:
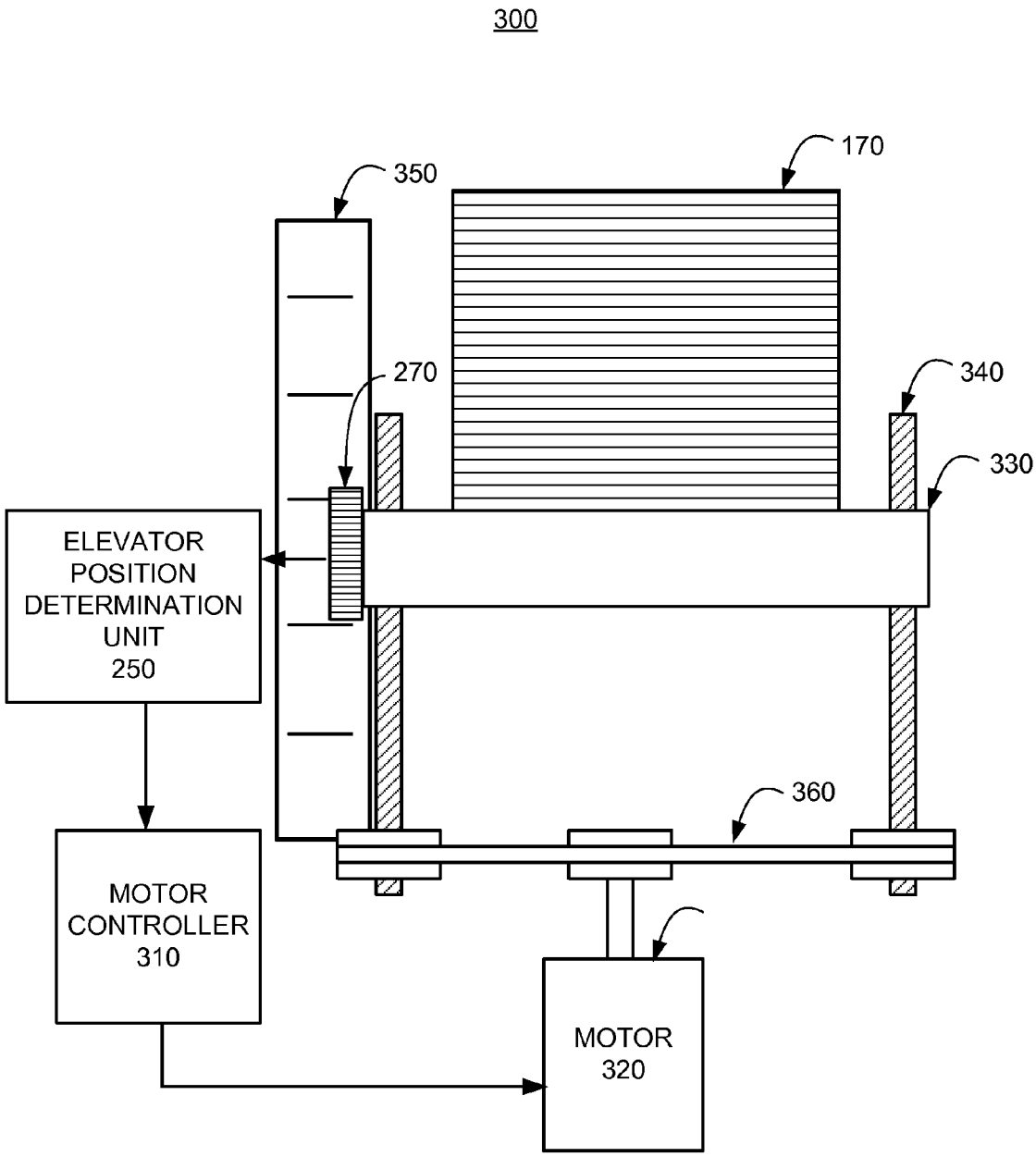
FIG. 3 is an exemplary diagram of the media amount determination environment in accordance with one possible embodiment of the disclosure.

FIG. 3 is an exemplary diagram of the media amount determination environment 300 in accordance with one possible embodiment of the disclosure. The media amount determination environment 300 may include an elevator 330 that may hold a media stack 170, the elevator position sensor 270, the elevator position determination unit 250, an segmented positional reference scale 350, a motor controller 310, motor 320, elevator leadscrew drive shafts 340, and elevator leadscrew drive belt 360.

The elevator 330 is a platform that holds a media stack 170 and moves vertically along the elevator leadscrew drive shafts 340. The elevator leadscrew drive shafts 340 are driven by the elevator leadscrew drive belt 360 which is in turn driven by the motor 310.

The elevator 330 may be a media feeder tray if located in the feeder section 110. Thus, as media from the media stack 170 may be fed to the image production section 120, the elevator 330 may be lifted using the motor 310 which may the elevator leadscrew drive belt 360 based on signal from the elevator position determination unit 250 and motor controller 310.

The elevator 330 may also be a media stacker tray if located in the output section 130. Thus, as media may be fed from the image production section 120 and placed on the media stack 170 in the output section, the elevator 330 may be lowered using the motor 320 which may drive the elevator leadscrew drive belt 360 based on signal from the elevator position determination unit 250 and motor controller 310.

The elevator position sensor 270 may be attached to the elevator 330 for example and thus, may move up and down with the elevator 330. The sensor 270 may also be attached to other portions of elevator 330 structure as long as the functions of the sensor 270 sensing the reference marks on the segmented positional reference scale 350 is performed. The segmented positional reference scale 350 may be located on a fixed frame or other structure in one of a feeder section and an output section of the image production device 100.

The motor 320 and the elevator leadscrew drive belt 360 may represent any motor and drive mechanism that may perform the function of raising and lowering the elevator 330. The elevator position sensor 270 may represent one or more contact image sensors (CIS), and/or two-dimensional (2D) sensor arrays, for example.

Figure 4A:
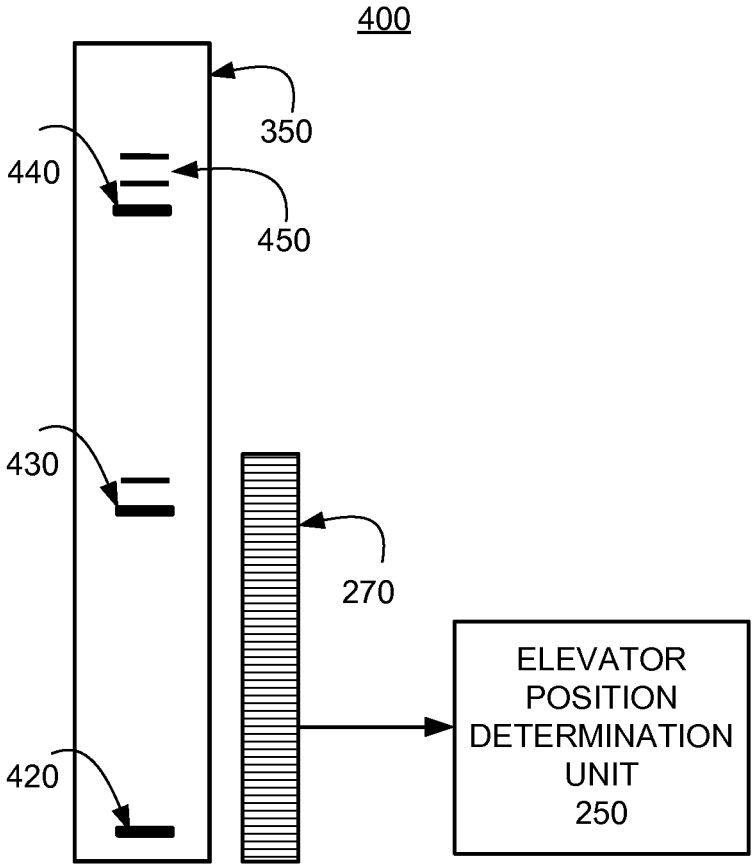
FIGS. 4A and 4B are exemplary diagrams illustrating the operation of the elevator position sensor and elevator position determination unit in accordance with one possible embodiment of the disclosure.
Figure 4B:
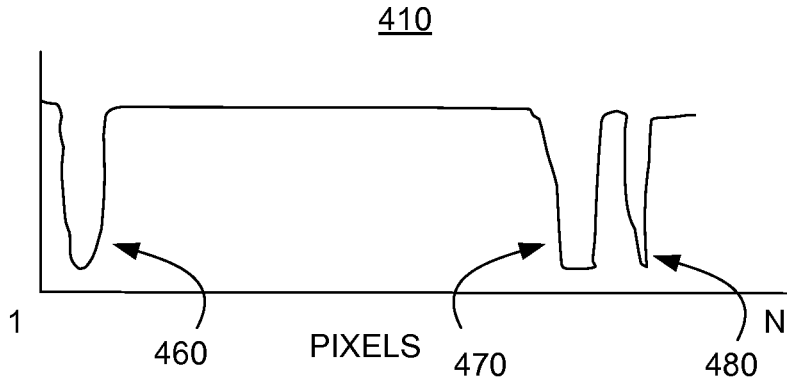

FIGS. 4A and 4B are exemplary diagrams illustrating the operation of the elevator position sensor and elevator position determination unit in accordance with one possible embodiment of the disclosure. FIG. 4A shows the segmented positional reference scale 350 with reference marks 420, 430, 440 450, the elevator position sensor 270, and the elevator position determination unit 250. The bold reference marks 420, 430, 440 may be marks indicating a segment. The lighter reference marks 450 found above the bold reference mark 420, 430, 440 may serve to identify the respective segment. For example, in FIG. 4A, the first segment may be identified with just reference mark 420 and no lighter reference marks 450. However, the second segment and third segments may be identified by the number of lighter reference marks 450 that are located above the bold reference mark 420, 430, 440 (one lighter reference marks 450 for the second segment and two lighter reference marks 450 for the third segment). While the reference marks are shown in a particular pattern, any pattern of reference marks or any other location identifying scheme may be used within the spirit and scope of the disclosed embodiments as long as the location identifying scheme may be read by the elevator position sensor 270.

FIG. 4B shows the output of the elevator position sensor 270 as sent to the elevator position determination unit 250. As shown, the first low-signal drop 460 corresponds to the reference mark 420. The second low signal drop 470 may correspond to the reference mark 430 and the low-signal 480 that has the smaller number of pixels may correspond to the reference mark 450 in the second segment, thus indicating the second segment with reference mark 430 and one lighter reference mark 450. Thus, the elevator position determination unit 250 may determine the elevator 330 position from these signals as the sensor 270 which may be attached to the elevator 330 may read reference marks at particular pixels.

Note that while FIG. 4B shows a particular signal pattern, other signal patterns may be used or methods to enable the elevator position determination unit 250 to determine the elevator position (and hence, the amount of media 170 on the elevator 330) within the spirit and scope of the disclosed embodiments.

Figure 5:
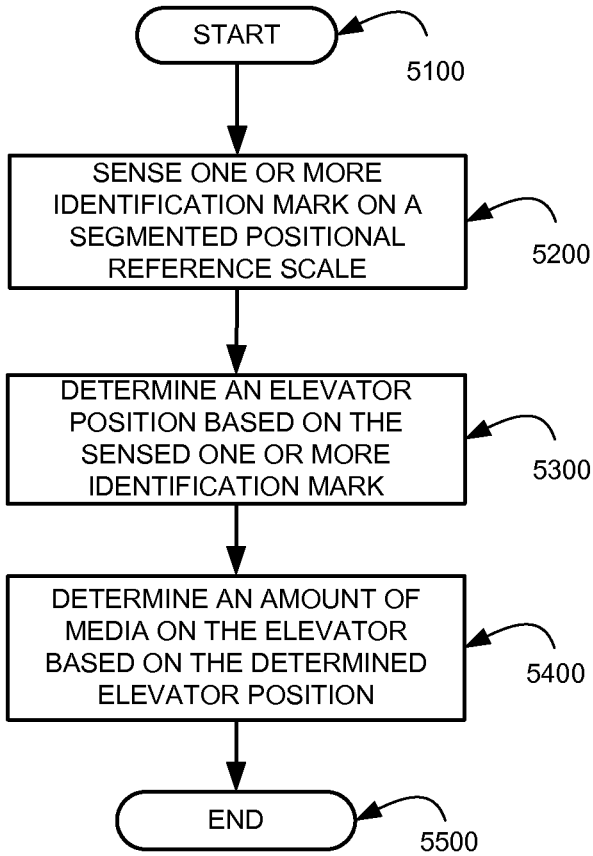
FIG. 5 is a flowchart of an exemplary media amount determination process in accordance with one possible embodiment of the disclosure.

FIG. 5 is a flowchart of an exemplary media amount determination process in accordance with one possible embodiment of the disclosure. The method may begin at step 5100, and may continue to step 5200 where the elevator position sensor 270 may sense one or more identification mark 420, 430, 440, 450 on the segmented positional reference scale 350.

At step 5300, the elevator position determination unit 250 may determine the elevator 330 position based on the sensed one or more identification mark 420, 430, 440, 450. At step 5400, the elevator position determination unit 250 may determine an amount of media 170 on the elevator 330 based on the determined elevator position. The process may then go to step 5500 and end.

Note, that the elevator position determination unit 250 may receive other inputs from other controllers, processors or sensors to determine the amount of media on the elevator 330. Note also that the determined amount of media may be approximate and may depend on other factors such as the type of media, media thickness, media curl, media size, fluffing, etc.

The determined elevator position may be used for other purposes in the image production device 100. For example, knowing the elevator 330 position may be important for safety reasons, maintenance purposes, indicating a media tray (elevator) full condition (e.g., if the elevator 330 is detected in a "low" position), or media tray empty condition (e.g., if the elevator 330 is detected in a "high" position).

If the elevator 330 is a media feeding tray or associated with a media feeding tray located in a feeder section 110 of the image production device 100, the elevator position determination unit 250 may determine whether the amount of media 170 on the elevator 330 is below a predetermined threshold. If the elevator position determination unit 250 determines that the amount of media 170 on the elevator 330 is below the predetermined threshold, the elevator position determination unit 250 may communicate at least one of the amount of media 170 on the elevator 330 and a warning to add media 170 to the media feeding tray to a user through a user interface 150.

If the elevator 330 is a media stacking tray or associated with a media stacking tray located in an output section 130 of the image production device 100, the elevator position determination unit 250 may determine whether the amount of media 170 on the elevator 330 is above a predetermined threshold. If the elevator position determination unit 250 determines that the amount of media 170 on the elevator 330 is above the predetermined threshold, the elevator position determination unit 250 may communicate at least one of the amount of media 170 on the elevator 330 and a warning to empty the media stacking tray to a user through a user interface 150.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hard-wired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method for determining the amount of media on an elevator that supports a media stack in an image production device, comprising:

sensing one or more identification mark on a segmented positional reference scale;

determining the elevator's position based on the sensed one or more identification mark; and determining an amount of media on the elevator based on the determined elevator position, wherein the elevator is associated with a media stacking tray located in an output section of the image production device and the method further comprising:

determining whether the amount of media on the elevator is above a predetermined threshold, wherein if it is determined that the amount of media on the elevator is above the predetermined threshold, communicating at least one of the amount of media on the elevator and a warning to empty the media stacking tray to a user through a user interface.

2. The method of claim 1, wherein sensing is performed by one of a contact image sensor (CIS), and a two-dimensional (2D) sensor array.

3. The method of claim 1, wherein the segmented positional reference scale is located on a fixed frame in one of a feeder section and an output section of the image production device.

4. The method of claim 1, wherein the sensing is performed by a sensor attached to the elevator.

5. The method of claim 1, wherein the elevator is associated with media feeding tray located in a feeder section of the image production device and the method further comprising:

determining whether the amount of media on the elevator is below a predetermined threshold, wherein if it is determined that the amount of media on the elevator is below the predetermined threshold, communicating at least one of the amount of media on the elevator and a warning to add media to the media feeding tray to a user through a user interface.

6. The method of claim 1, wherein the image production device is one of a copier, a printer, a facsimile device, and a multi-function device.

7. An image production device, comprising:

a segmented positional reference scale;

an elevator position sensor that senses one or more identification mark on the segmented positional reference scale;

an elevator position determination unit that determines an elevator position based on the sensed one or more identification mark, and determines an amount of media on the elevator based on the determined elevator position a user interface; and an output section, wherein the elevator is associated with a media stacking tray located in the output section of the image production device and the elevator position determination unit determines whether the amount of media on the elevator is above a predetermined threshold, wherein if the elevator position determination unit determines that the amount of media on the elevator is above the predetermined threshold, the elevator position determination unit communicates at least one of the amount of media on the elevator and a warning to empty the media stacking tray to a user through a user interface.

8. The image production device of claim 7, wherein the elevator position sensor is one of a contact image sensor (CIS), and a two-dimensional (2D) sensor array.

9. The image production device of claim 7, wherein the segmented positional reference scale is located on a fixed frame in one of a feeder section and an output section of the image production device.

10. The image production device of claim 7, wherein the elevator position sensor is attached to the elevator.

11. The image production device of claim 7, further comprising:

a user interface; and a feeder section, wherein the elevator is associated with a media feeding tray located in the feeder section of the image production device and the elevator position determination unit determines whether the amount of media on the elevator is below a predetermined threshold, wherein if the elevator position determination unit determines that the amount of media on the elevator is below the predetermined threshold, the elevator position determination unit communicates at least one of the amount of media on the elevator and a warning to add media to the media feeding tray to a user through the user interface.

12. The fluff management unit of claim 7, wherein the image production device is one of a copier, a printer, a facsimile device, and a multi-function device.

13. A computer-readable medium storing instructions for determining the amount of media on an elevator that supports a media stack in an image production device, the instructions comprising:

sensing one or more identification mark on a segmented positional reference scale;

determining the elevator's position based on the sensed one or more identification mark; and determining an amount of media on the elevator based on the determined elevator position, wherein the elevator is associated with a media stacking tray located in an output section of the image production device and the instructions further comprising:

determining whether the amount of media on the elevator is above a predetermined threshold, wherein if it is determined that the amount of media on the elevator is above the predetermined threshold, communicating at least one of the amount of media on the elevator and a warning to empty the media stacking tray to a user through a user interface.

14. The computer-readable medium of claim 13, wherein sensing is performed by one of a contact image sensor (CIS), and a two-dimensional (2D) sensor array.

15. The computer-readable medium of claim 13, wherein the segmented positional reference scale is located on a fixed frame in one of a feeder section and an output section of the image production device.

16. The computer-readable medium of claim 13, wherein the sensing is performed by a sensor attached to the elevator.

17. The computer-readable medium of claim 13, wherein the elevator is associated with a media feeding tray located in a feeder section of the image production device and the instructions further comprising:

determining whether the amount of media on the elevator is below a predetermined threshold, wherein if it is determined that the amount of media on the elevator is below the predetermined threshold, communicating at least one of the amount of media on the elevator and a warning to add media to the media feeding tray to a user through a user interface.

18. The computer-readable medium of claim 13, wherein the image production device is one of a copier, a printer, a facsimile device, and a multi-function device.

* * * * *